US005231963A

United States Patent [19]

Perkins

[11] Patent Number: 5,231,963

[45] Date of Patent: Aug. 3, 1993

[54] FUEL SAVING AND EMISSION REDUCTION DEVICE

[75] Inventor: John P. Perkins, Wilsonville, Oreg.

[73] Assignee: National Marketing Corp., Oregon City, Oreg.

[21] Appl. No.: 667,560

[22] Filed: Mar. 11, 1991

[51] Int. Cl.[5] ..... F02M 29/00

[52] U.S. Cl. ..... 123/306; 123/592

[58] Field of Search ..... 123/590, 592, 306

[56] References Cited

U.S. PATENT DOCUMENTS

| | | | |
|---|---|---|---|
| 1,051,369 | 1/1913 | Heath . | |
| 2,027,480 | 1/1936 | Higley . | |
| 2,051,556 | 8/1936 | Higley . | |
| 2,161,182 | 6/1939 | Massey . | |
| 2,251,999 | 8/1941 | Greco . | |
| 2,969,782 | 1/1961 | Falzone | 123/592 |
| 3,544,290 | 12/1970 | Larson, Sr. et al. . | |
| 3,615,296 | 10/1971 | Guarnaschelli | 48/189.5 R |
| 3,847,128 | 11/1974 | Palotsee | 123/592 |
| 3,945,361 | 3/1976 | Piotrowicz, Sr. | 123/590 |
| 3,952,716 | 4/1976 | McCauley | 123/549 |
| 4,011,850 | 3/1977 | Knox, Sr. | 123/592 |
| 4,059,082 | 11/1977 | McCauley | 123/549 |
| 4,153,028 | 5/1979 | Kumm et al. | 123/592 |
| 4,153,653 | 5/1979 | Moore | 48/189.5 |
| 4,163,436 | 8/1979 | Fugett | 123/592 |
| 4,399,800 | 8/1983 | Weidelmayer | 123/592 |
| 4,422,432 | 12/1983 | Knox, Sr. | 123/592 |
| 4,473,057 | 9/1984 | Collins | 123/592 |
| 4,671,247 | 6/1987 | Barbee | 123/592 |

FOREIGN PATENT DOCUMENTS

| | | | |
|---|---|---|---|
| 46-25801 | 7/1971 | Japan | 123/592 |
| 8304071 | 11/1983 | PCT Int'l Appl. | 123/592 |
| 337973 | 11/1930 | United Kingdom | 123/592 |
| 339756 | 12/1930 | United Kingdom | 123/592 |
| 341620 | 1/1931 | United Kingdom | 123/592 |

*Primary Examiner*—David A. Okonsky
*Attorney, Agent, or Firm*—Kolisch, Hartwell, Dickinson, McCormack & Heuser

[57] ABSTRACT

A device for increasing fuel efficiency in an internal combustion engine and for reducing emissions, including a rotor assembly positioned entirely within the manifold of the engine and including a post secured to the bottom of the manifold below the carburetor and mounting a freely rotatable rotor on the top of the post adjacent the carburetor opening of the manifold. The rotor includes a plurality of angled slots therethrough whereby the flow of the combustible mixture impels the rotor to spin. The spinning rotor causes the droplets of gasoline to further vaporize, thus boosting the fuel efficiency of the engine and reducing emissions.

18 Claims, 3 Drawing Sheets

FUEL SAVING AND EMISSION REDUCTION DEVICE

TECHNICAL FIELD

This invention relates to internal combustion engines and more particularly to an improvement in carburetor by the installation of a rotor assembly in the manifold for the purpose of more thoroughly atomizing particles of gasoline not completely vaporized in the carburetor.

BACKGROUND ART

The basic function of a carburetor is to provide an intimate mixture of fuel and air for consumption by an internal combustion engine. Efficiency of mixing depends upon atomizing the fuel into minute particles. Large particles, or droplets, allow some of the fuel to avoid contact with air in the combustion chambers of the engine and thus to go through the engine unburned.

The typical modern carburetor provides a duct through which air is drawn by the pumping action of the engine and atomizing is accomplished by delivering fuel in liquid form through a small nozzle to the center of the air stream. Owing to a vacuum which is created in the vicinity of the nozzle by the movement of the air, the fuel is drawn out of the nozzle, separated into droplets and carried into the engine.

It is found, however, that this method of mixing is not perfect. Certain air to fuel ratios are considered optimum for achieving an efficient burning of the fuel-air mixture. For example, fourteen parts air to one part gasoline is considered to be an excellent air to fuel ratio. But considering that with the prior carburetor systems some of the fuel remains in too large of droplets to mix with the air sufficiently to burn in the combustion chambers, the carburetor is usually adjusted to provide an overabundance of fuel to the engine. This causes waste of the fuel and usually causes the discharge of pollutants into the atmosphere through the engine exhaust system. Even with carburetors that are in proper operating condition, exhaust analyses show that a significant portion of the fuel is never burned. With the current and ever increasing concern with the shortage of fuels, and the dangers of air pollution, it is becoming urgent to reduce fuel waste and reduce the exhaust of pollutants to the atmosphere.

Numerous prior inventors have attempted to address this problem in the past. Many designs of devices have been proposed for more thoroughly atomizing the fuel after the air-fuel stream exits the carburetor. It is known to place a vaned rotor in the area between the carburetor and the manifold, and that such a rotor, so located, will serve to more thoroughly atomize the fuel. However, such prior art devices have many practical limitations.

One basic problem with inline devices as are known in the prior art is that the unit disposed between the carburetor and the manifold elevates the carburetor further above the engine. This disrupts all of the plumbing to the carburetor. But more importantly with today's compact engine compartments there is usually not sufficient room to elevate the carburetor without interfering with the closing of the engine compartment's hood. This is increasingly a concern with more emphasis being placed on an aerodynamically efficient exterior body shape.

Another limitation with prior art devices relates to their durability. It can be appreciated that there are significant forces at play in a rapidly spinning rotor assembly. Frictional forces generate sufficient heat that most prior art rotors seize up after a relatively short service life. These problems are compounded by vibration that occurs readily if the rotor is at all out of balance. With prior art rotors having vanes stamped out of sheet metal, balance and durability problems are common. Further, the assembly is in a constant solvent environment (gasoline) and this precludes most common bearing arrangements, and prohibits many materials from being useful as bushings.

Accordingly, it is the general object of the present invention to provide a rotor assembly for improving the fuel efficiency of an internal combustion engine.

Another object is to locate said rotor assembly in the manifold of the engine.

Yet another object is to have no need for elevation of the carburetor in the installation of the rotor assembly.

A further object is to provide a machined rotor so that balance is improved.

Yet another object is to provide a long wearing bushing assembly.

Still another object is to simplify the structure and installation of the motor assembly into an existing engine.

These and other objects and advantages of the present invention and the manner in which they are achieved will be made apparent as the specification and claims proceed, taken in conjunction with the drawings which illustrate the preferred embodiment.

SUMMARY OF THE INVENTION

In its basic concept, the present invention is a fuel saving and emission reduction device for use in an internal combustion engine, including a post secured in the bottom of the manifold directly below the carburetor opening and mounting a rotor on top of the post, the rotor having a plurality of angled slots therethrough whereby the flow of the combustible mixture impels the rotor to spin and thus further atomizes the fuel in the combustible mixture.

DESCRIPTION OF THE PREFERRED EMBODIMENT

Figure 1:
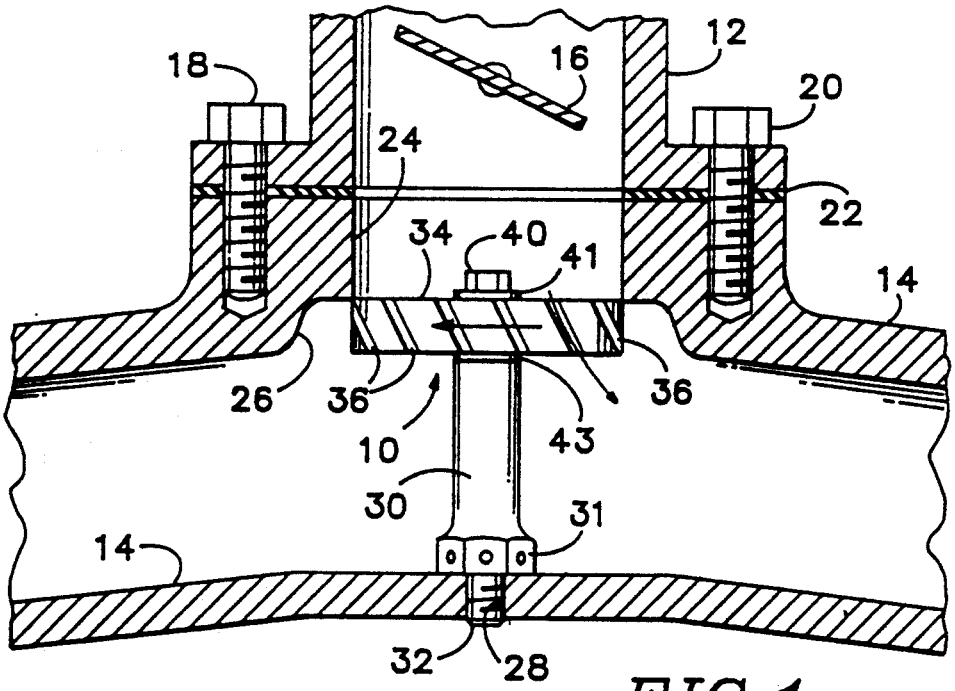
FIG. 1 is a side view illustrating the fuel saving and emission reduction device of the present invention in its environment, with fragmentary portions of the carburetor and the manifold shown in section.

The fuel saving and emission reduction device of the present invention is shown in its general environment in FIG. 1. A rotor assembly, denoted generally at 10 is mounted below carburetor 12 in manifold 14. The carburetor is of the conventional type, without any special modification. As such, only a fragmentary part of it is shown in the drawings, including its base and a throttle plate 16 in its barrel. The carburetor is secured to the manifold conventionally by bolts 18 and 20, with a gasket 22 for sealing purposes. It is to be noted that the height or position of the carburetor is not modified by the installation of the rotor assembly of the present invention.

In the top of the manifold 14 is a hole or carburetor opening denoted at 24 aligned with the barrel of the carburetor. In most engines there is an exact alignment of the hole, straight into the manifold. Inside the manifold the interior is flared out as illustrated at 26.

To install the rotor assembly 10 in the manifold 14 a hole 28 is drilled and threaded in the bottom of the manifold directly below the center of the carburetor opening 24. The rotor assembly includes a post 30 which has a bottom end 31 and a stud 32 which is threaded for engagement into hole 28. The bottom end is preferably hexagonal for the purpose of fitting with a socket wrench for easy and secure installation. Alternatively, post 30 can be a hexagonal rod. A thread lock compound is used on threaded end 32 to make the installation permanent.

Figure 2:
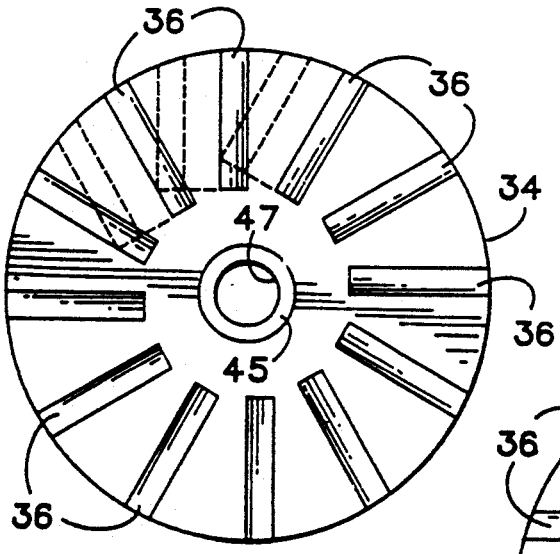
FIG. 2 is a top plan view of the rotor of the fuel saving and emission reduction device of the present invention.
Figure 3:
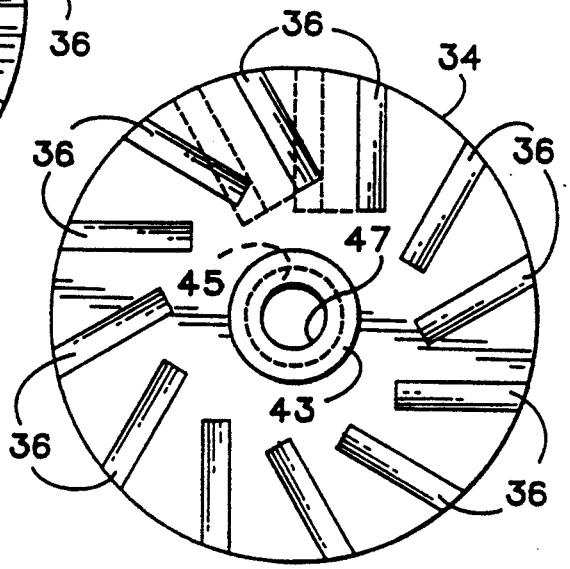
FIG. 3 is a bottom view of the rotor of FIG. 2.

A rotor 34 is mounted on top of the post 30. The rotor is preferably a circular plate of solid material such as aluminum and can have various diameters, but usually ranges from 1-3 inches in diameter. A plurality of slots 36 are machined or otherwise formed into the rotor. FIG. 2 illustrates the top of the rotor and FIG. 3 illustrates the bottom of the rotor, both showing the particular configuration of the angled slots. In the preferred embodiment, each slot is formed at from 20 to 45 degrees from vertical, preferably about 30 degrees. The number of slots typically varies from 6 to 24 slots around the circumference of the rotor, preferably about 12 slots as shown. Of course, other angles and numbers of slots can be used. The critical thing is the balance of the rotor, which can be maintained by careful fabrication of the slots.

Figure 6:
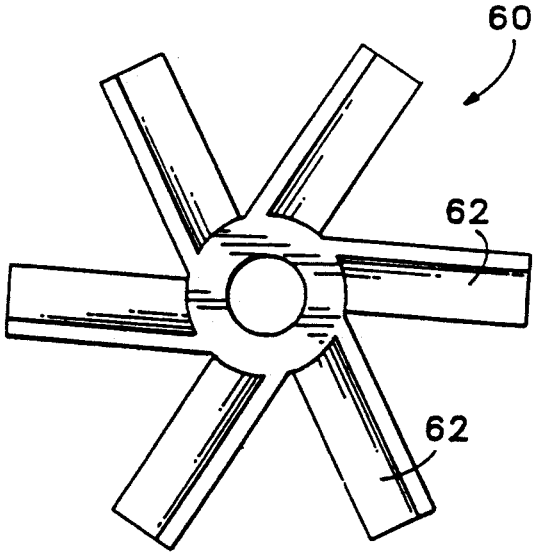
FIG. 6 is a top plan view of an alternate rotor for use in the invention.
Figure 7:
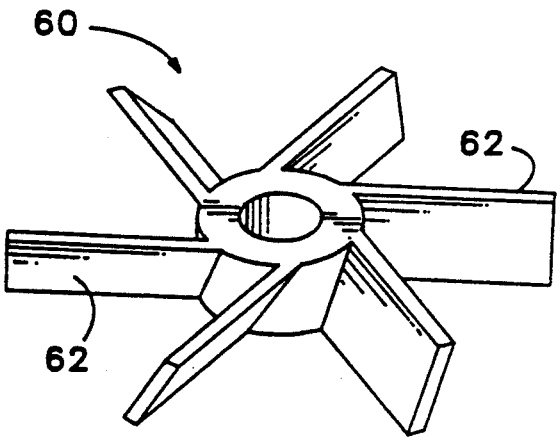
FIG. 7 is a perspective view of the rotor of FIG. 6.

FIG. 6 and 7 show an alternative rotor at 60. Rotor 60 is similar to rotor 34 except the material between every other slot has been removed and the vanes themselves are thinner, as shown by vanes 62. Rotor 60 is lighter than rotor 34 and therefore is applicable in different situations, such as with a fuel injection engine rather than an engine with a carburetor.

The position of the rotor 34 in manifold 14 is very important. Preferably the rotor's top surface is located just at the bottom of the carburetor opening 24 at the point of the beginning of the flared out section 26. The diameter of the rotor is preferably substantially equal to the size of the carburetor opening, just enough undersized to be able to fit the rotor through the opening for installation. Of course the height and diameter of the rotor are individual for each type of engine. For those engines having more than one barrel carburetor, a corresponding number of rotor assemblies of the present invention are installed. The arrows in FIG. 1 illustrate the flow of the combustible material through the slots and the resultant direction of the spinning of the rotor.

Figure 4:
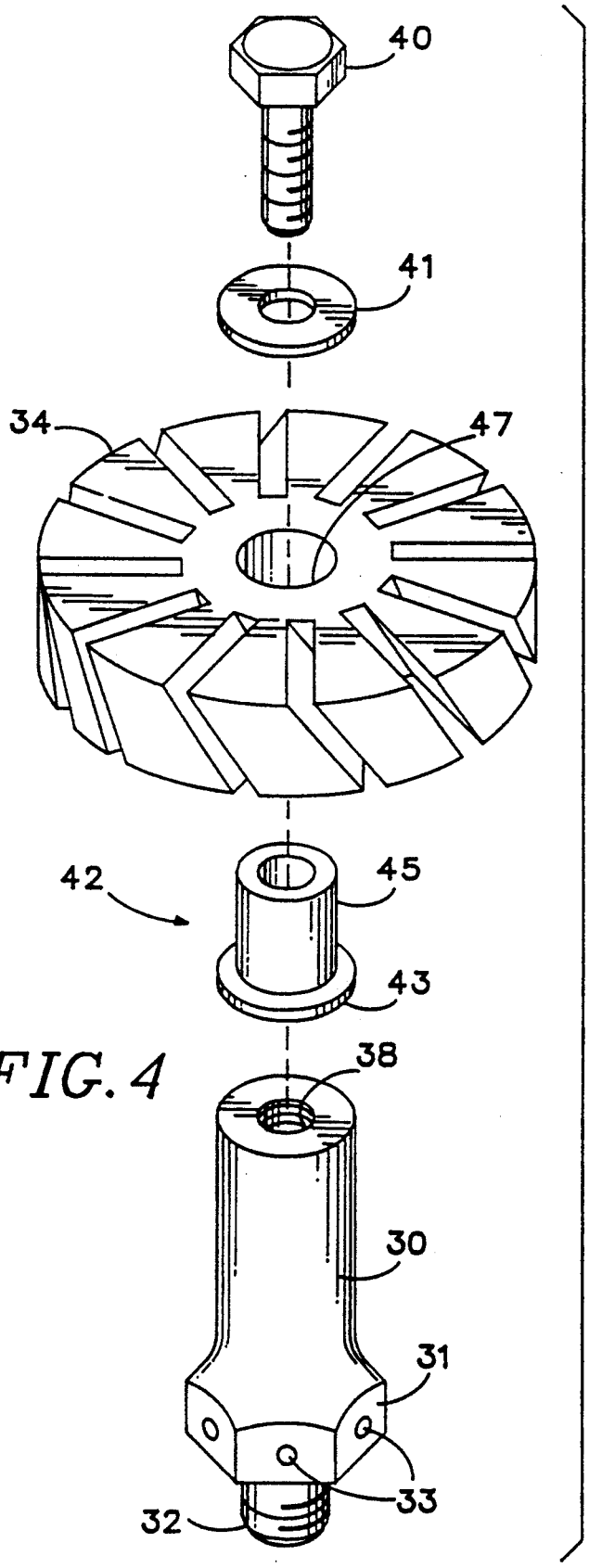
FIG. 4 is a fragmentary exploded view of the component assembly of the fuel saving and emission reduction device of the present invention.

FIG. 4 best illustrates the components of the rotor assembly 10. Retainer means is provided for holding the rotor 34 on the post 30. Preferably this comprises a threaded hole 38 in the top of the post which receives a bolt 40. The depth of the hole is so sized that the bolt binds before tightly gripping rotor 34, thus allowing the rotor to rotate freely on top of the post. The bolt extends through a washer 41, the rotor 34 and a bearing 42 which is press fit on axis into the rotor. The bearing and washer facilitate the rotation of the rotor on the post.

Bearing 42 includes a shoulder flange 43 and a main section 45. Section 45 is inserted into a hole 47 in rotor 34. Shoulder 43 abuts the bottom surface of rotor 34 and rests against the top surface of post 30. Thus, shoulder 43 supports the weight of rotor 34 and allows the rotor to spin on its surface.

Bearing 42 is preferably made of a self lubricating, low friction material which is unaffected by exposure to gasoline vapor. In the preferred embodiment, the bearing is a nylon/TEFLON TM /oil-based thermoplastic with a heat resistance within the range of 150° F.-260° F. The material from which the bearing is made should be smooth to reduce friction when the rotor spins. The material should also have a chemical resistance to gasoline and other carbon-based products and should be able to be machined, shaped or molded. Additionally, the material should be hard enough to withstand the environment of a manifold and to support the weight of the flywheel and down-pressure of air flowing from the carburetor through the manifold. The down pressure of air for cars less than 50,000 miles is usually 15-20 pounds per square inch. In other applications such as race cars the down pressure may range from 20 to 30 pounds per square inch. Additionally, the material has to have a limited thermal expansion so that it will not cause the rotor to freeze on bolt 40 when the bearing is heated.

One material that meets these requirements is IMILON TM 511 available from W. P. Shamban & Co. in Carson, Calif. Another acceptable material is TERCITE TM brand graphite and moly filled PTFE, also available from W. S. Shamban & Co.

As explained above, the bottom end 31 of post 30 is hexagonal to facilitate attachment of the post into the manifold of a car. In each surface of the hexagonal end 31, a hole such as hole 33 in FIG. 4 is cut completely through the post. Each surface on the hexagonal end has such a hole. The holes allow heat from the manifold to dissipate before the heat travels up post 30 to bearing 42. Specifically, holes 33 increase the surface area of post 30, thereby allowing air to dissipate the heat from the manifold more quickly.

Figure 5:
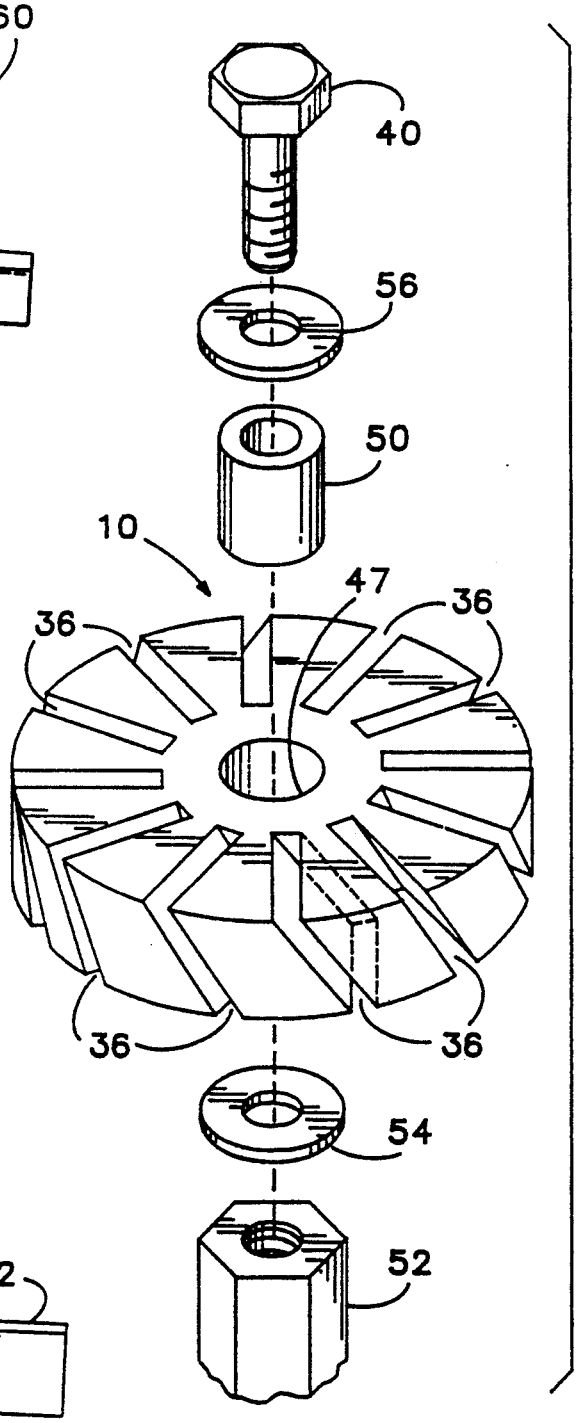
FIG. 5 is an exploded view of a second embodiment of the invention.

FIG. 5 is an alternative view of the invented device with a cylindrical bearing 50 and a hexagonal post 52. A washer 54 is positioned between rotor 34 and post 52. A second washer 56 is positioned under bolt 40 and above rotor 34.

The installation of the present invention into an internal combustion engine requires only that the carburetor be temporarily removed. Then a hole is drilled and threaded in the bottom of the manifold and post 30 installed. Rotor 34 is then lowered through the carburetor opening and the assembly is retained together by bolt 40. The carburetor is then replaced and the engine run normally.

The incoming stream of combustible mixture is pulled through the carburetor and through the rotor assembly by the normal aspiration of the engine The air flowing through causes the rotor to begin to rotate at high speed. Droplets which are too large coming from the carburetor hit the rotating rotor and are broken down into fine mist which is combustible. The fine mist causes more of the gasoline to burn, thereby increasing fuel efficiency and decreasing emissions.

INDUSTRIAL APPLICABILITY

The invented fuel saving and emission reduction device is applicable in the automotive and transportation industries. While a preferred embodiment of the invention has been described, variations and changes may be made without departing from the spirit of the invention.

I claim:

1. A fuel saving and emission reduction device for use in an internal combustion engine having a carburetor, and therebelow a manifold for receiving a combustible mixture of gasoline and air from the carburetor through a carburetor opening in the manifold for distribution to the combustion chambers of the engine, the device comprising:

(a) a nonmoveable post secured to the bottom of the manifold directly below the carburetor opening and extending upwardly through the manifold;

(b) a rotor mounted freely rotatably on the top of the post and positioned near the carburetor opening, the rotor having a plurality of angled slots therethrough whereby the flow of the combustible mixture impels the rotor to spin; and (c) retainer means for holding the rotor on the post.

2. The fuel saving and emission reduction device of claim 1 further comprising a bearing mounting the rotor on the post.

3. The fuel saving and emission reduction device of claim 2 wherein the bearing is made from a nylon/oil-based thermoplastic.

4. The fuel saving and emission reduction device of claim 2 wherein the bearing is made from a durable compound resistant to high temperature.

5. The fuel saving and emission reduction device of claim 1 wherein the post has a bottom end that includes a machined threaded section for engagement with a threaded hole in the bottom of the manifold, and wherein the top end of the post has a longitudinal threaded hole therein, and wherein the retainer means comprises a bolt extending through the rotor and engaging the hole in the top of the post.

6. The fuel saving and emission reduction device of claim 1 wherein the rotor is positioned with its top surface adjacent the bottom of the carburetor opening in the manifold.

7. The fuel saving and emission reduction device of claim 1 wherein the rotor comprises a circular plate of solid material having angled slots formed therein.

8. The fuel saving and emission reduction device of claim 7 wherein the rotor has a diameter substantially equal to the carburetor opening.

9. The fuel saving and emission reduction device of claim 7 wherein each slot is oriented at between 20 and 45 degrees from vertical.

10. The fuel saving and emission reduction device of claim 7 wherein the rotor has from 6 to 24 slots therein.

11. A fuel saving and emission reduction device for use in an internal combustion engine having a carburetor, and therebelow a manifold for receiving a combustible mixture of gasoline and air from the carburetor through a carburetor opening in the manifold for distribution to the combustion chambers of the engine, the device comprising:

(a) a nonmoveable post secured to the bottom of the manifold directly below the carburetor opening and extending upwardly through the manifold;

(b) a rotor mounted freely rotatably on the top of the post and positioned near the carburetor opening, the rotor having a plurality of angled slots therethrough whereby the flow of the combustible mixture impels the rotor to spin; and (c) retainer means for holding the rotor on the post wherein the post has a bottom end and holes cut through the post in the bottom end to facilitate the dissipation of heat.

12. A fuel saving and emission reduction device for use in an internal combustion engine having an intake passage for receiving a combustible mixture along an axis of flow, the device comprising:

a nonmovable post; and a rotor rotatably mounted to the post, the rotor having slots which receive the combustible mixture substantially parallel to the axis of flow and pass the combustible mixture therethrough.

13. The device of claim 12 wherein the rotor includes vanes.

14. The device of claim 12 wherein the rotor comprises a disc having a plurality of slots cut therein.

15. The device of claim 12 further including a bearing mounting the rotor on the post.

16. The device of claim 15 wherein the bearing comprises a shoulder flange attached to a cylindrical main section.

17. The device of claim 16 wherein the bearing is made from a durable compound resistant to high temperature.

18. A fuel saving and emission reduction device for use in an internal combustion engine having an intake passage for receiving a combustible mixture along an axis of flow, the device comprising a rotatable disc having a plurality of angled slots cut therein which receive the combustible mixture substantially parallel to the axis of flow and pass the combustible mixture therethrough.

* * * * *